United States Patent [19]

Porteous et al.

[11] Patent Number: 4,887,867

[45] Date of Patent: Dec. 19, 1989

[54] RANGING DRUM SHEARERS

[75] Inventors: Alexander Porteous, Motherwell; Angus J. McIntosh, Lanark, both of United Kingdom

[73] Assignee: Anderson Strathclyde PLC, Glasgow, Scotland

[21] Appl. No.: 242,197

[22] Filed: Sep. 9, 1988

[30] Foreign Application Priority Data

Sep. 10, 1987 [GB] United Kingdom ..... 8721325

[51] Int. Cl.[4] ..... E21C 27/01; E21C 31/10

[52] U.S. Cl. ..... 299/42; 299/53

[58] Field of Search ..... 299/42–46, 299/51–54, 76, 29

[56] References Cited

U.S. PATENT DOCUMENTS

| | | | |
|---|---|---|---|
| 3,907,367 | 9/1975 | Nakajima | 299/53 |
| 3,945,680 | 3/1976 | Henrich et al. | 299/43 |
| 4,465,319 | 8/1984 | Brownlie | 299/42 |

FOREIGN PATENT DOCUMENTS

| | | | |
|---|---|---|---|
| 3527253 | 11/1986 | Fed. Rep. of Germany . | |
| 43895 | 11/1960 | Poland | 299/51 |
| 250823 | 2/1970 | U.S.S.R. | 299/43 |

*Primary Examiner*—Bruce M. Kisliuk
*Assistant Examiner*—David J. Bagnell
*Attorney, Agent, or Firm*—Mason, Fenwick & Lawrence

[57] ABSTRACT

The invention relates to ranging drum shearers having cutting drums driven by electric motors mounted on the respective ranging arms. A coal sizer is pivotably mounted on a shroud of the motor and is maintained at a constant disposition regardless of the position of the ranging arm. The coal sizer is maintained at a constant disposition through a control arm pivotally mounted to the pivot axis of the ranging arm and having a keyway containing a key on the axis of the coal sizer. The key and keyway provide for longitudinal movement of the coal sizer relative to the shearer body whereby on the pivotal movement of the ranging arm, the control arm remains stationary and the distance between the key and the axis of the shroud is maintained by the longitudinal adjustment of the coal sizer in the keyway.

8 Claims, 5 Drawing Sheets

RANGING DRUM SHEARERS

BACKGROUND AND OBJECTS OF THE INVENTION

This invention relates to ranging drum shearers and in particular to double ended shearers in which the cutter drums are each driven by a transverse electric motor mounted on the respective ranging arm.

Ranging arm shearers are track mounted and run along the track in both directions. The track incorporates a conveyor to carry the cut coal and that conveyor runs in only one direction according to the layout of the mine.

When the shearer is running in the same direction as the conveyor the cut coal falls into the conveyor ahead of the machine, but when the shearer is running against the run of the conveyor, the cut coal passes under the machine body. Consequently a low powered lump breaker, or 'coal sizer' is mounted across the relevant end of the machine to reduce large lumps of coal to a size sufficient to pass under the machine body.

A problem which arises with electric drum-drive shearers is how best to mount a coal sizer and its associated transvers electric motor across the end face of the machine body.

One known arrangement provides an arm extending longitudinally of the goaf side of the machine and carrying the coal sizer and electric motor at its outer end. A disadvantage of such an arrangement is that the arm lies alongside the electric motor which drives the drum of that ranging arm, so if that motor requires to be removed, the coal sizer arm together with the coal sizer and its electric motor must first be removed and later replaced. As the arm has to carry the coal sizer and its electric motor, it is a relatively heavy member and its removal and replacement with the coal sizer and motor still attached is labour intensive or requires the use of lifting apparatus.

An object of this invention is to provide a coal sizer mounting which obviates or mitigates the aforementioned problem.

According to one aspect of the present invention there is provided a ranging drum shearer wherein the or each cutter drum is driven by a transverse electric motor mounted on the or each ranging arm, the or each electric motor being contained in a cylindrical shroud, a coal sizer pivotally mounted on a shroud and disposed at a selected height above a datum, and means to retain the coal sizer in said disposition when the associated ranging arm is pivotally raised or lowered.

According to another aspect of the present invention there is provided a ranging drum shearer in which a ranging arm is pivotally mounted on at least one end of the body of the shearer and carries a cutter drum, the or each arm having an associated transversely mounted electric motor which drives the cutter drum of said arm, said electric motor being contained within a transversely disposed cylindrical shroud mounted on or integral with the ranging arm and spaced longitudinally of the axis of rotation of the ranging arm, a coal sizer and an associated transversely mounted electric motor spaced from an end face of the body and having mounting means to engage the adjacent shroud for rotational movement relative thereto about the axis of the shroud, and means to maintain constant the disposition of the coal sizer in use relative to a conveyor below the body of the shearer when the ranging arm is raised or lowered.

Preferably, said means to maintain constant the disposition of the coal sizer relative to the conveyor comprises an arm longitudinally disposed and pivotally mounted at one end on the axis of the ranging arm, a keyway in said arm containing a key on the axis of the coal sizer to provide for longitudinal movement of the coal sizer relative to the body of the shearer whereby on pivotal movement of the ranging arm and corresponding movement of the shroud, said arm remains stationary and The distance between the key and the transverse axis of the shroud is maintained by longitudinal adjustment of the coal sizer in the keyway, Preferably also, the coal size position-control arm is retained stationary by means of a hydraulic ram which can also be used to alter the disposition of the arm and thus the height-setting of the coal sizer and to cushion the shock loading on the coal sizer during use.

DETAILED DESCRIPTION OF A PREFERRED EMBODIMENT

Figure 1:
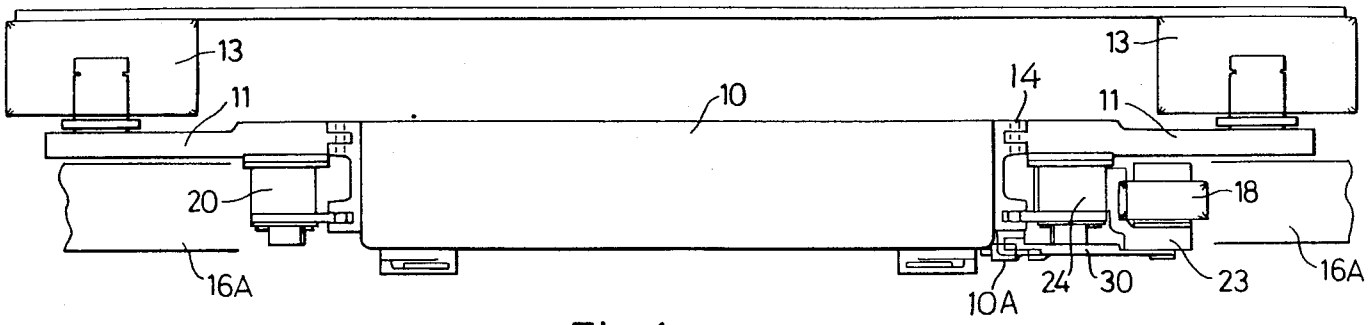
FIG. 1 is a plan view of a ranging drum shearer according to the invention.
Figure 2:
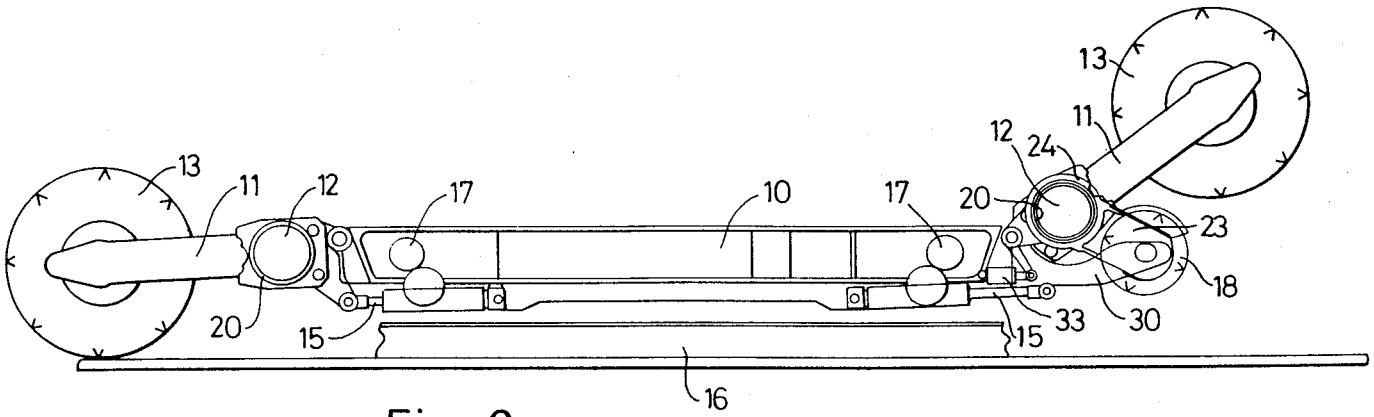
FIG. 2 is a side elevation of FIG. 1.

An embodiment of the present invention will now be described, by way example with reference to the accompanying drawings. Referring firstly to FIGS. 1 and 2, the mining machine in the form of a ranging drum shearer has an elongate body or main frame 10 and a ranging arm 11 is mounted at each end of the body. Each ranging arm carries a cutter drum 13 at its outer end and a transverse electric motor 12 which is located at the inner end of the arm 11 and drives the cutter drum 13 associated with that arm 11.

Each ranging arm is pivotal about a transverse axis or hinge point 14 on the body 10 or on a bracket 10A bolted to the body by action of a hydraulic cylinder 15. The drive motor 12 is, for example, an A/C constant speed motor.

Figure 3:
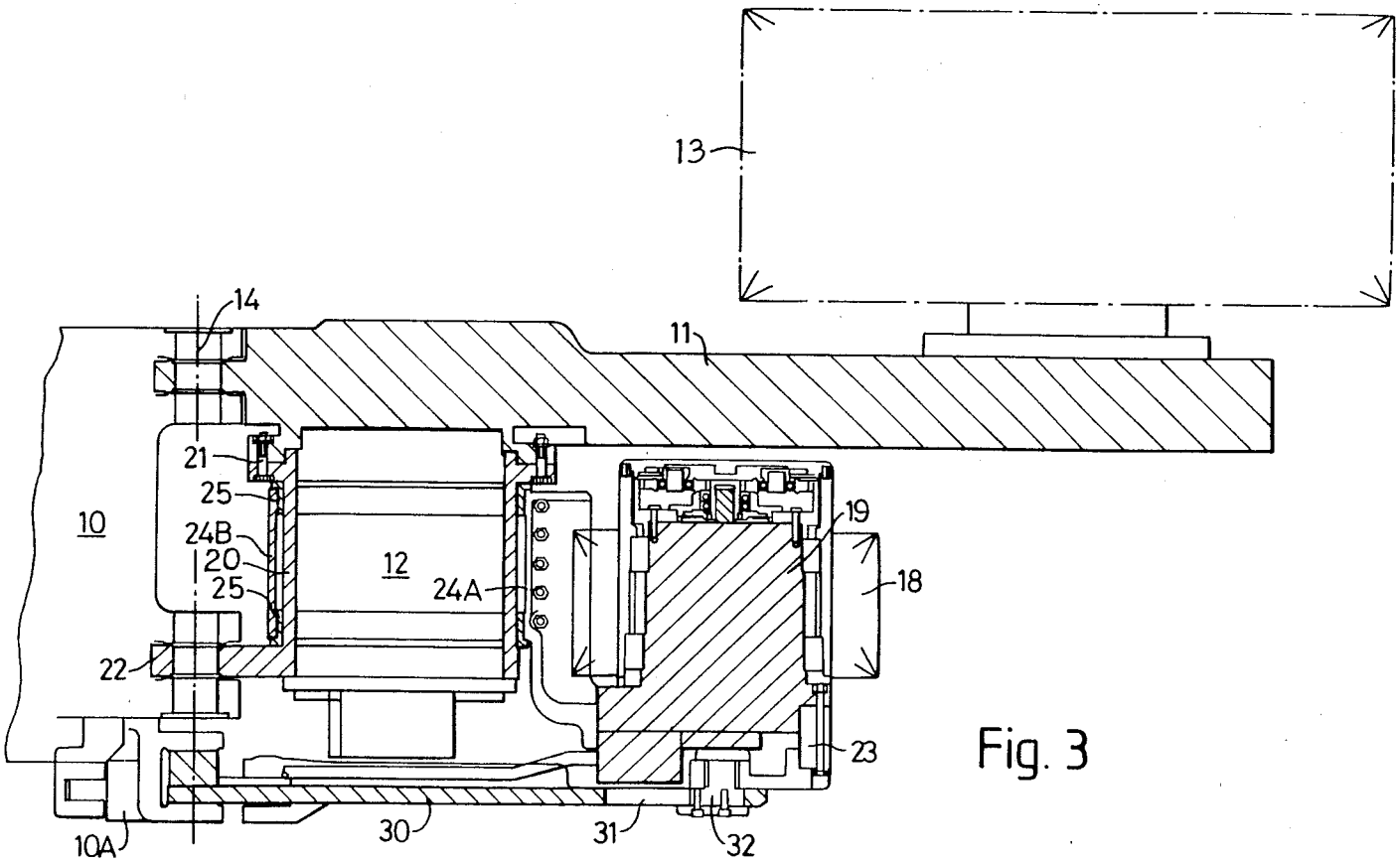
FIG. 3 is a detail in plan to a larger scale of portion of a ranging arm and coal sizer mounting.
Figure 4:
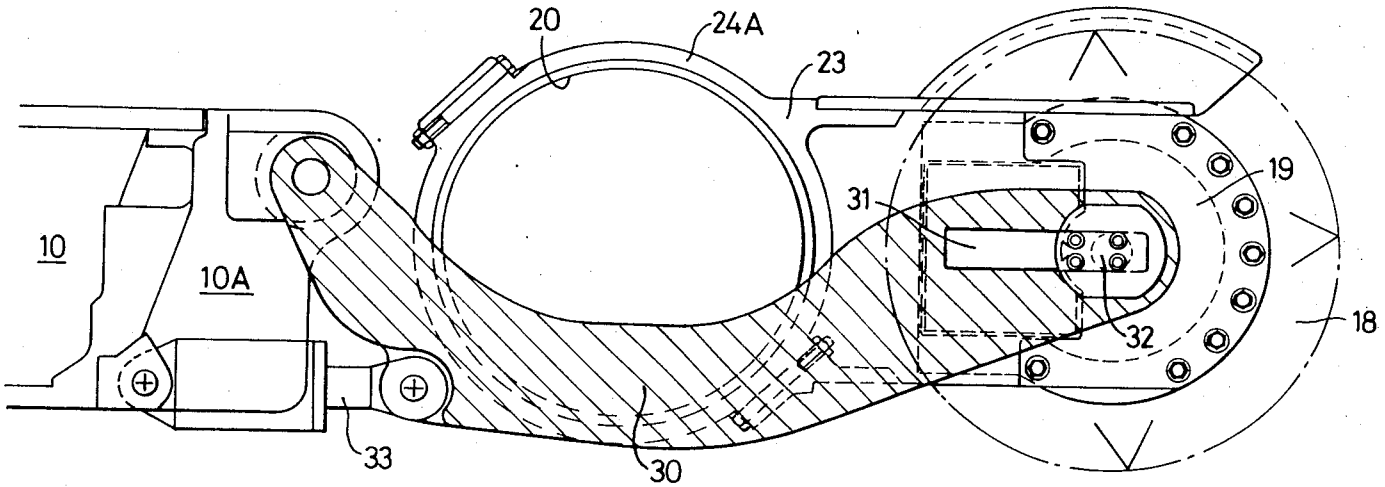
FIG. 4 is a side elevation of the coal sizer mounting.

The machine is driven along a track 16 by a pair of drive units 17 mounted on the machine body 10 each having an electric motor or a hydraulic or mechanical haulage drive. Cut coal is transported on a conveyor 16A on the track 16 and in this embodiment, the conveyor runs from right to left when viewed in FIGS. 1 and 2. In order that large lumps of coal can be reduced to a size sufficient to pass under the body 10 of the machine when the machine is running from left to right, i.e. opposite to the direction of travel of the belt 16A, a low powered lump breaker or more specifically, a coal sizer 18 is mounted across the right hand end face of the body 10 in advance of the drum drive electric motor 12. The coal sizer shown in FIGS. 1 and 2 is more specifically illustrated in FIGS. 3 and 4. The coal sizer is driven by, for example, an A/C constant speed motor 19.

Each drum-drive electric motor 12 is contained in a transverse cylindrical shroud 20 which is bolted at 21 to the ranging arm 11, but may be integral therewith. The shroud 20 has an end portion 22 remote from the ranging arm 11 and said end portion 22 is pivotally mounted about the ranging drum hinge point 14. Thus the shroud 20 will pivot when the ranging arm 11 pivots.

The coal sizer 18 is carried on the shroud 20 by a mounting 23 which includes a cylindrical sleeve 24 formed in two parts (24A, 24B) for location around the shroud 20. Bearings 25 are provided between the sleeve 24 and shroud 20 so that the sleeve is rotatable thereon. Thus when the shroud 20 pivots as the ranging arm 11 moves up or down, the coal sizer 18 will tend to move with the shroud. However, means is provided to restrain the coal sizer so that it remains stationary while sleeve 24 rotates around the shroud 20.

The means to restrain the coal sizer comprises a position-control arm 30 which is mounted on the goaf side of the body, and is pivotal about the ranging drum hinge point 14 on the machine body. The control arm 30 extends longitudinally away from the body 10 and terminates alongside the coal sizer 18. The arm 30 has a longitudinal keyway 31 at its outer end and the coal sizer 18 has a co-axial key 32 which is pivotal relative thereto and which locates in the keyway 31. The arm 30 is pivotal by action of a hydraulic cylinder 33 mounted on the machine body and connected to the arm below the hinge 14, and the height of the coal sizer can be set relative to a datum, such as the track conveyor, by operation of the cylinder 33.

Figure 5:
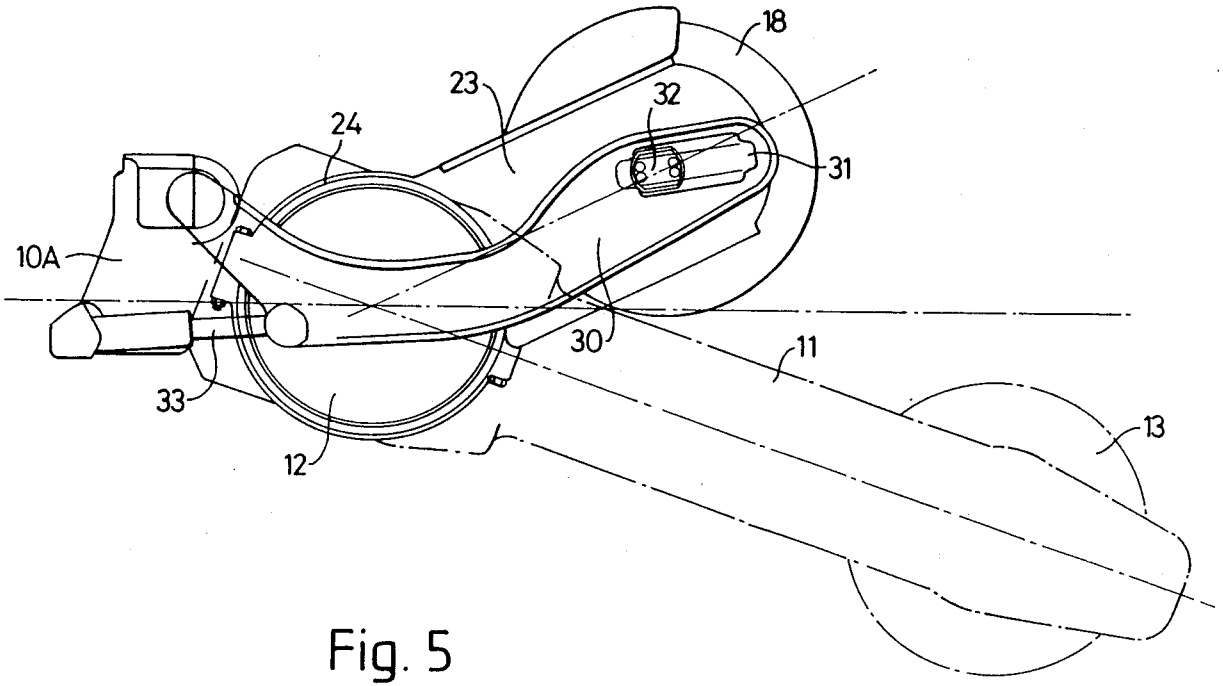
FIGS. 5 and 6 illustrate pivotal dispositions of the ranging arm.
Figure 6:
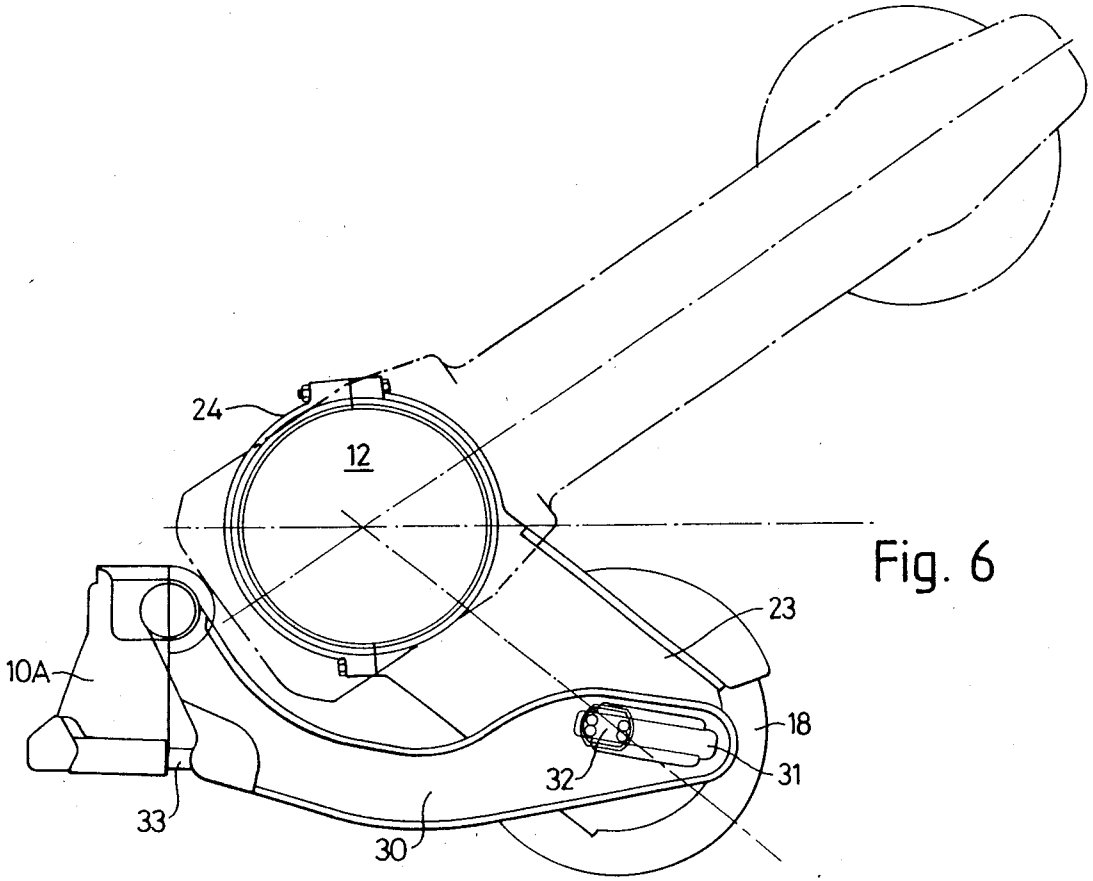

The arm 30 and keyway arrangement 31/32 serve to maintain the coal sizer at its pre-set height when the ranging arm is pivoted upwardly or downwardly, as illustrated in FIGS. 5 and 6.

When the ranging arm 11 pivots upwards or downwards to a maximum of e.g. 35°, the shroud 20 also pivots. The arm 30 however, remains stationary and the coal sizer is prevented from upward or downward movement by the keyway arrangement 31/32; the key 32 pivots and slides along the keyway 31 so that the distance L between the transverse axis of the coal sizer and the transverse axis of the shroud remains constant. Thus as the ranging arm pivots to cut the coal face, the height of the coal sizer 18 above the conveyor 16A remains constant.

The control arm cylinder 33 acts as a cushion by taking the shock loading on the coal sizer during use.

The arm 30 is curved to provide a concave portion adjacent to the drum drive electric motor 12 within the shroud 20. This then allows the motor 12 to be removed as and when necessary, e.g. for repair or replacement. In order to do so the hydraulic ram 33 is retracted to its inner limit so as to lower the arm 30 below the level of the shroud, with the ranging arm horizontal, see FIG. 4.

Thus, the drum drive electric motor 12 can be removed without the need even to remove the control arm 30.

The arm 30, being simply a control arm rather than a ranging arm for the coal sizer, can be relatively light and easily removed and replaced, if necessary.

While use of the coal sizer is more practical on a double ended shearer, it could, if required, be used on a single ended shearer.

We claim:

1. A ranging drum shearer, comprising a shearer body, at least one ranging arm carrying a cutter drum and mounted on at least one end of the shearer body, a transverse electric motor mounted on each ranging arm to drive the associated cutter drum, said electric motor being contained in a cylindrical shroud, a coal sizer pivotally mounted on the shroud and disposed at a selected height above a datum, means to maintain constant the disposition of the coal sizer in use relative to a conveyor below the body of the shearer when the ranging arm is raised and lowered, said means to maintain constant the disposition of the coal sizer relative to the conveyor comprising a position control arm longitudinally disposed and pivotally mounted at one end on the axis of the ranging arm, a keyway in said control arm containing a key on the axis of the coal sizer to provide for longitudinal movement of the coal sizer relative to the body of the shearer whereby on pivotal movement of the ranging arm and corresponding movement of the shroud, said control arm remains stationary and the distance between the key and the transverse axis of the shroud is maintained by longitudinal adjustment of the coal sizer in the keyway.

2. A shearer as claimed in claim 1 in which the coal sizer position-control arm is retained stationary by means of a hydraulic ram which can also be used to alter the means of a hydraulic ram which can also be used to alter the disposition of the arm and thus the height-setting of the coal sizer and to cushion the shock loading on the coal sizer during use.

3. A shearer as claimed in claim 1 in which the position-control arm can be pivotally depressed below the level of the shroud when the ranging arm 11 is horizontal to enable transverse removal of the drum drive electric motor from the shroud.

4. A shearer as claimed in claim 3, in which the position control arm is curved to provide a concave upper surface to allow the arm, when depressed to lie below the level of the shroud.

5. A ranging drum shearer a shearer body, at least one ranging arm pivotally mounted on at least one end end of the body of the shearer and carrying a cutter drum, each arm having an associated transversely mounted electric motor which drives the cutter drum of said arm, said electric motor being contained within a transversely disposed cylindrical shroud on the ranging arm and spaced longitudinally of the axis of rotation of the ranging arm, a coal sizer and an associated transversely mounted electric motor spaced from an end of the body and having mounting means to engage the adjacent shroud for rotational movement relative thereto about the axis of the shroud, means to maintain constant the disposition of the coal sizer in use relative to a conveyor below the body of the shearer when the ranging arm is raised or lowered, said means to maintain constant the disposition of the coal sizer relative to the conveyor comprising a position control arm longitudinally disposed and pivotally mounted at one end on the axis of the ranging arm, a keyway in said control arm containing a key on the axis of the coal sizer to provide for longitudinal movement of the coal sizer relative to the body of the shearer whereby on pivotal movement of the ranging arm and corresponding movement of the shroud, said control arm remains stationary and the distance between the key and the transverse axis of the shroud is maintained by longitudinal adjustment of the coal sizer in the keyway.

6. A shearer as claimed in claim 5, in which the coal sizer position-control arm is retained stationary by means of a hydraulic ram which can also be used to alter the disposition of the arm and thus the height-setting of the coal sizer and to cushin the shock loading on the coal sizer during use.

7. A shearer as claimed in claim 5, in which the position-control arm can be pivotally depressed below the level of the shroud when the ranging arm is horizontal to enable transverse removal of the drum drive electric motor from the shroud.

8. A shearer as claimed in claim 7 in which the position control arm is curved to provide a concave upper surface to allow the arm, when depressed to lie below the level of the shroud.

* * * * *